US011035363B2

(12) United States Patent
Ikeda et al.

(10) Patent No.: US 11,035,363 B2
(45) Date of Patent: Jun. 15, 2021

(54) VANE PUMP

(71) Applicant: TAIHO KOGYO Co., Ltd., Toyota (JP)

(72) Inventors: Satoshi Ikeda, Toyota (JP); Ken Nakamuta, Toyota (JP)

(73) Assignee: TAIHO KOGYO Co., Ltd., Toyota (JP)

( * ) Notice: Subject to any disclaimer, the term of this patent is extended or adjusted under 35 U.S.C. 154(b) by 229 days.

(21) Appl. No.: 16/086,386

(22) PCT Filed: Feb. 27, 2017

(86) PCT No.: PCT/JP2017/007490
§ 371 (c)(1),
(2) Date: Sep. 19, 2018

(87) PCT Pub. No.: WO2017/163770
PCT Pub. Date: Sep. 28, 2017

(65) Prior Publication Data

US 2019/0101117 A1 Apr. 4, 2019

(30) Foreign Application Priority Data

Mar. 24, 2016 (JP) ..... JP2016-059822

(51) Int. Cl.
*F03C 2/00* (2006.01)
*F03C 4/00* (2006.01)
(Continued)

(52) U.S. Cl.
CPC ..... *F04C 18/344* (2013.01); *F04C 18/3442* (2013.01); *F04C 25/02* (2013.01);
(Continued)

(58) Field of Classification Search
CPC .. F04C 2/3441; F04C 3/3442; F04C 18/3441; F04C 18/3442; F04C 15/0088;
(Continued)

(56) References Cited

U.S. PATENT DOCUMENTS 3,877,851 A * 4/1975 Komiya ..... F04C 18/3441 418/76
4,772,188 A * 9/1988 Kimura ..... F04C 29/0021 418/55.6
(Continued)

FOREIGN PATENT DOCUMENTS

CN 105392994 A 3/2016
EP 1 553 301 A1 7/2005
(Continued)

OTHER PUBLICATIONS

Chinese Office Action dated Oct. 22, 2019 in Chinese Patent Application No. 201780018866.7 (with English translation), 10 pages.
(Continued)

*Primary Examiner* — Theresa Trieu
(74) *Attorney, Agent, or Firm* — Oblon, McClelland, Maier & Neustadt, L.L.P.

(57) ABSTRACT

A vane pump including: a housing having a pump chamber; a rotor having a cylindrical peripheral wall portion accommodated in the pump chamber and having a pair of vane holding grooves facing each other in a diameter direction, and an oil chamber defined inside the peripheral wall portion to store lubricating oil; and a vane that is held in the pair of vane holding grooves and moves across the oil chamber in the diameter direction, is provided. At least one of an inner surface of the housing and an end face of the peripheral wall portion, which together with the inner surface defines a sliding interface, has an oil groove for the lubricating oil.

8 Claims, 11 Drawing Sheets

(51) Int. Cl.

| | |
|---|---|
| ***F04C 2/00*** | (2006.01) |
| ***F04C 18/00*** | (2006.01) |
| ***F04C 18/344*** | (2006.01) |
| ***F04C 25/02*** | (2006.01) |
| ***F04C 29/02*** | (2006.01) |
| ***F04C 27/00*** | (2006.01) |

(52) U.S. Cl.
CPC ..... *F04C 27/001* (2013.01); *F04C 29/021* (2013.01); *F04C 29/025* (2013.01); *F04C 29/028* (2013.01); *F04C 27/005* (2013.01); *F04C 2230/92* (2013.01); *F04C 2240/20* (2013.01); *F04C 2240/30* (2013.01); *F04C 2250/20* (2013.01)

(58) Field of Classification Search
CPC ..... F04C 25/02; F04C 27/005; F04C 27/001; F04C 29/021; F04C 29/023; F04C 29/025; F04C 29/028; F04C 2230/92; F04C 2240/20; F04C 2240/30; F04C 2250/20
See application file for complete search history.

(56) References Cited

U.S. PATENT DOCUMENTS

| | | | | |
|---|---|---|---|---|
| 7,878,777 | B2 * | 2/2011 | Iwanami | F04C 18/0215 418/55.5 |
| 2004/0190804 | A1 * | 9/2004 | John | F16C 17/04 384/420 |
| 2011/0064598 | A1 * | 3/2011 | Kishi | F04C 18/3442 418/255 |
| 2012/0076682 | A1 * | 3/2012 | Sakakibara | F04C 18/3442 418/255 |
| 2015/0036955 | A1 * | 2/2015 | Nomura | F16C 33/205 384/368 |
| 2016/0084252 | A1 | 3/2016 | Yamazaki | |
| 2016/0097391 | A1 * | 4/2016 | Kitazawa | F04C 18/3442 418/255 |
| 2016/0108916 | A1 | 4/2016 | Horibe et al. | |

FOREIGN PATENT DOCUMENTS

| | | | |
|---|---|---|---|
| EP | 2 151 542 | A2 | 2/2010 |
| EP | 2 982 865 | A1 | 2/2016 |
| JP | 48-072504 | | 9/1973 |
| JP | 48-072504 | U | 9/1973 |
| JP | 2000-73975 | A | 3/2000 |
| JP | 2004-263690 | A | 9/2004 |
| JP | 2008-231954 | A | 10/2008 |
| WO | WO 2004/036046 | A1 | 4/2004 |

OTHER PUBLICATIONS

Indian Examination Report dated Feb. 25, 2020, in Patent Application No. 201817039544, 6 pages.
Office Action dated May 20, 2019 in corresponding Chinese Patent Application No. 201780018866.7 (with English Translation), 7 pages.
International Search Report dated May 23, 2017 in PCT/JP2017/007490 (with English translation), 5 pages.
International Preliminary Report on Patentability and Written Opinion dated Oct. 4, 2018 in PCT/JP2017/007490 (with English translation), 13 pages.
Office Action dated Feb. 6, 2018 in Japanese Patent Application No. 2016-059822 (with English translation), 8 pages.
Office Action dated Jun. 19, 2018 in Japanese Patent Application No. 2016-059822 (with English translation), 5 pages.
Extended European Search Report dated Mar. 11, 2019, in European Patent Application No. 17769815.6, 6 pages.

* cited by examiner

VANE PUMP

TECHNICAL FIELD

The present invention relates to vane pumps that are driven by, e.g., an engine of a vehicle.

BACKGROUND ART

Vane pumps include a rotor, a vane or vanes, and a housing. The housing includes a housing body having a recess, and a cover that seals the recess. A pump chamber is defined in the housing. The rotor and the vane(s) are rotatably accommodated in the pump chamber. An oil film is formed in a sliding interface between one axial end face (thrust surface) of the rotor and the inner surface of the cover. If the oil film becomes discontinuous, the rotor and the inner surface of the cover tend to be in sliding contact with each other, and the rotor and the cover are therefore more likely to wear.

In this regard, Patent Document 1 discloses a vane pump having a plurality of biasing portions (coil springs). The plurality of biasing portions bias a rotor in the direction in which a thrust surface is separated from the inner surface of a cover (the direction in which a sliding interface is expanded). According to the vane pump of Patent Document 1, the rotor and the cover are therefore less likely to be in sliding contact with each other.

Patent Document 2 discloses a vane pump having a pair of oil grooves. The first oil groove is formed in the inner surface of a cover. The second oil groove is formed in the bottom surface of a recess of a housing body. The pair of oil grooves are arranged diagonally opposite each other as viewed from the outside in the radial direction. Even when a rotor is tilted in a pump chamber, a corner of the rotor on one axial end side (thrust surface side) of the rotor can enter the first oil groove. Similarly, a corner on the other axial end side of the rotor can enter the second oil groove. According to the vane pump of Patent Document 2, the rotor and a housing (the cover and the housing body) are less likely to unevenly contact each other. This restrains local wear of the thrust surface and the inner surface of the cover which is caused when the rotor is tilted.

RELATED ART DOCUMENTS

Patent Documents

[Patent Document 1] Japanese Patent Application Publication No. 2008-231954 (JP 2008-231954 A)

[Patent Document 2] Japanese Patent Application Publication No. 2004-263690 (JP 2004-263690 A)

SUMMARY OF THE INVENTION

Problem to be Solved by the Invention

In the vane pump of Patent Document 1, however, the number of parts is increased as the biasing portions are required. The plurality of biasing portions are fixed to the bottom surface of a recess of a housing body, whereas the rotor is rotated. A sliding member therefore need be additionally placed between the plurality of biasing portions and the rotor. In this respect as well, the number of parts is increased in the vane pump of Patent Document 1.

On the other hand, in the vane pump of Patent Document 2, no biasing portion is required and the number of parts is therefore not increased. In the vane pump of Patent Document 2, however, the amount by which the rotor is tilted may further be increased by an amount corresponding to the depth of the pair of oil grooves. This may reduce sealability of a sliding interface. It is an object of the present invention to provide a vane pump that restrains an increase in number of parts and that easily provides sufficient sealability of a sliding interface.

Means for Solving the Problem

In order to solve the above problems, a vane pump of the present invention is a vane pump including: a housing having a pump chamber; a rotor having a cylindrical peripheral wall portion accommodated in the pump chamber and having a pair of vane holding grooves facing each other in a diameter direction, and an oil chamber defined inside the peripheral wall portion to store lubricating oil; and a vane that is held in the pair of vane holding grooves and moves across the oil chamber in the diameter direction. The vane pump is characterized in that at least one of an inner surface of the housing and an end face of the peripheral wall portion, which together with the inner surface defines a sliding interface, has an oil groove for the lubricating oil.

Effects of the Invention

At least one of the inner surface of the housing and the end face of the peripheral wall portion of the rotor has an oil groove. The oil groove directly or indirectly communicates with the oil chamber of the rotor. The lubricating oil in the oil chamber of the rotor therefore directly or indirectly flows into the oil groove. According to the vane pump of the present invention, an oil film is therefore easily formed in the sliding interface. Accordingly, sufficient sealability of the sliding interface is easily provided, and the sliding interface is easily protected from thrust load. According to the vane pump of the present invention, members such as the biasing portions and the sliding member of Patent Document 1 need not be additionally disposed in order to provide sufficient sealability of the sliding interface. An increase in number of parts is thus restrained.

MODES FOR CARRYING OUT THE INVENTION

Embodiments of a vane pump of the present invention will be described below.

First Embodiment

[Configuration of Vane Pump]

Figure 1:
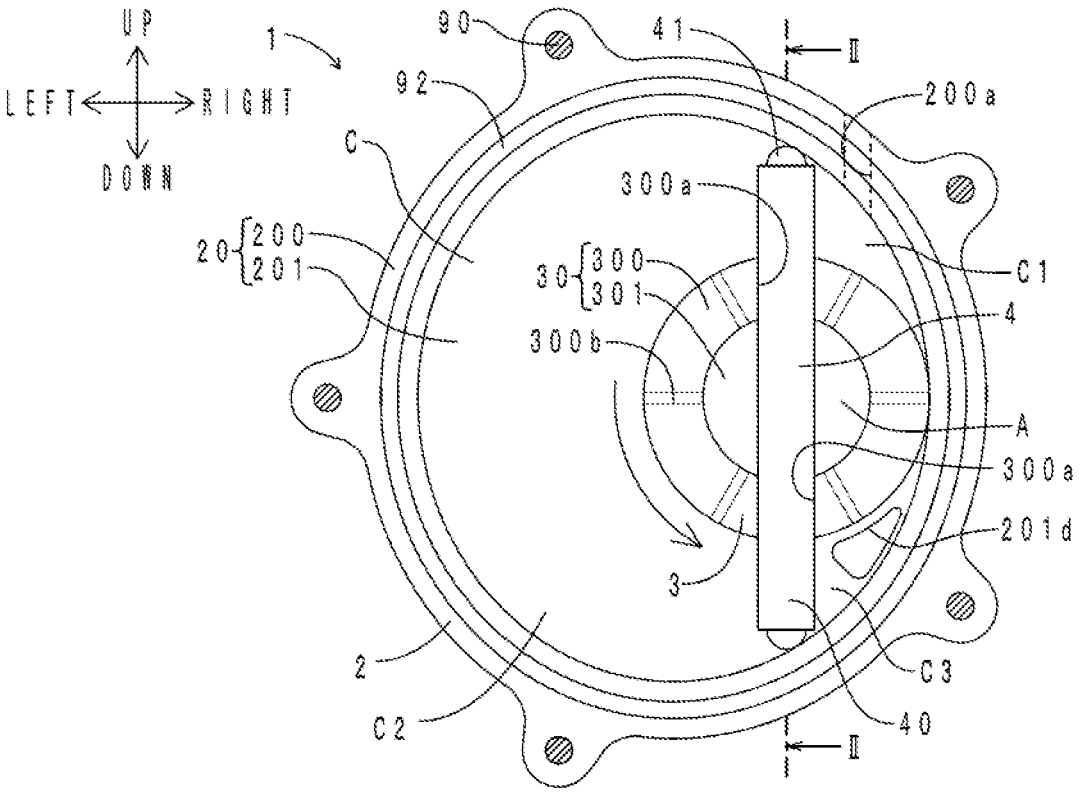
FIG. 1 shows a radial section of a vane pump of a first embodiment.
Figure 2:
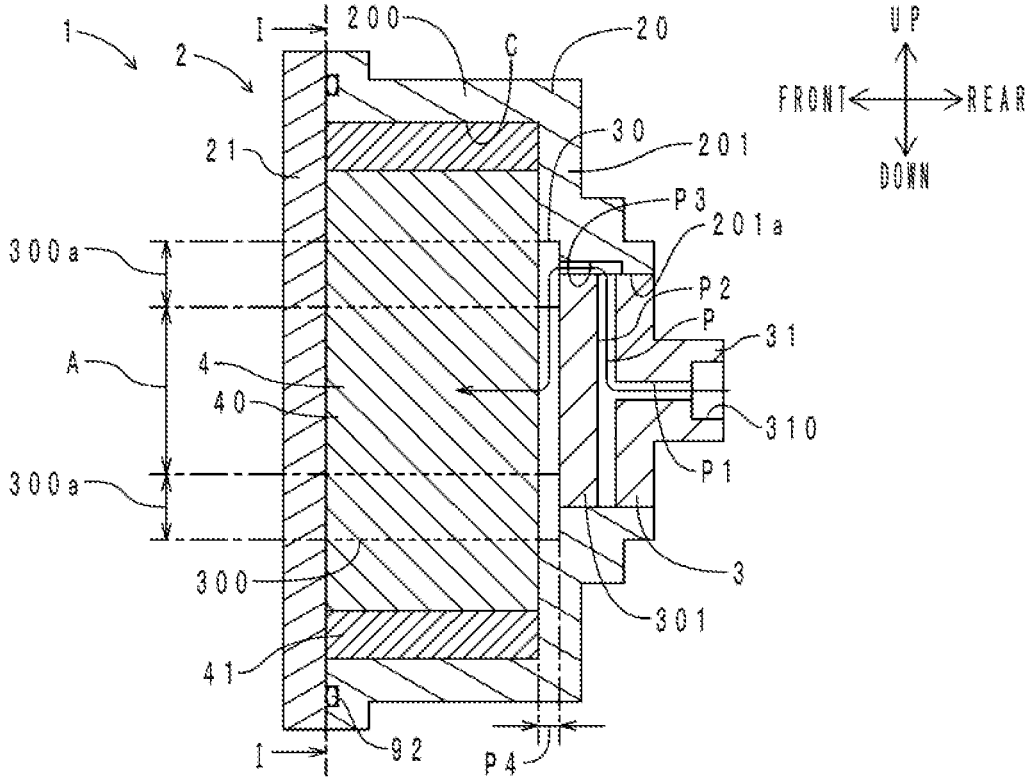
FIG. 2 is a sectional view taken along line II-II in FIG. 1.
Figure 3:
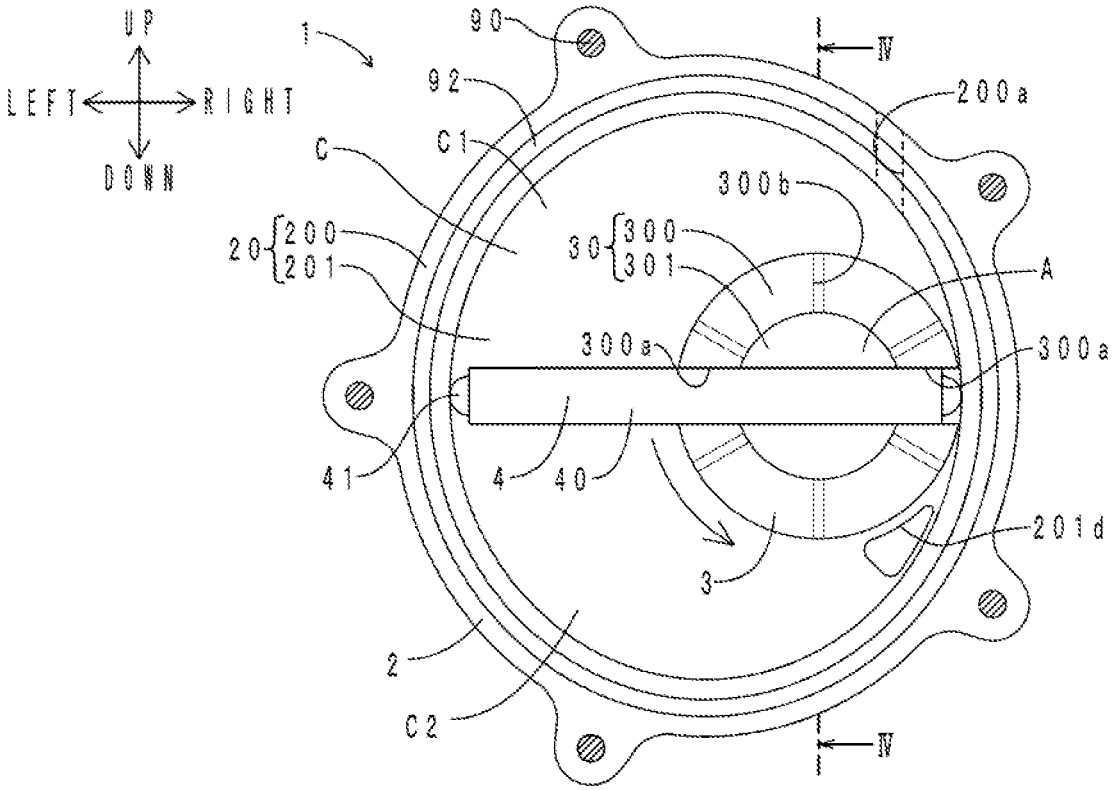
FIG. 3 shows a radial section of the vane pump.
Figure 4:
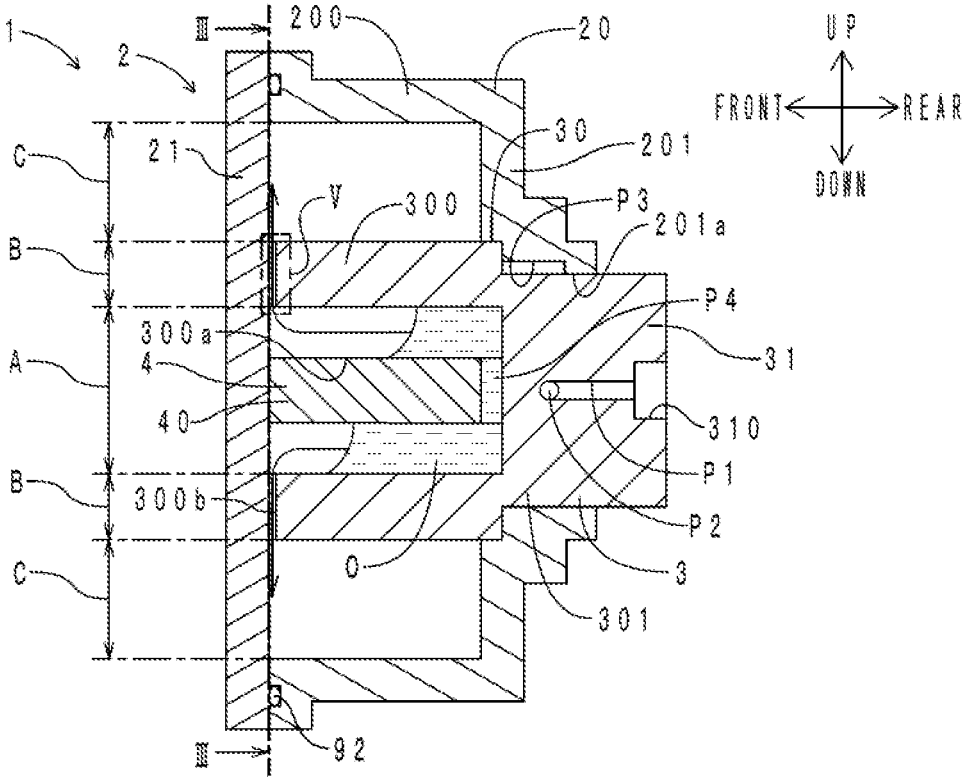
FIG. 4 is a sectional view taken along line IV-IV in FIG. 3.

First, the configuration of a vane pump of an embodiment will be described. FIG. 1 shows a radial section of the vane pump of the present embodiment. FIG. 2 is a sectional view taken along line II-II in FIG. 1. FIG. 3 shows a radial section of the vane pump. FIG. 4 is a sectional view taken along line IV-IV in FIG. 3. FIG. 1 corresponds to a section taken along line I-I in FIG. 2. FIG. 3 corresponds to a section taken along line III-III in FIG. 4. A rotor 3 and a vane 4 of a vane pump 1 shown in FIGS. 3 and 4 have been rotated (advanced) by 90° with respect to those of the vane pump 1 shown in FIGS. 1 and 2. The vane pump 1 is a negative pressure source of a booster of a brake device. The vane pump 1 is driven to rotate by a camshaft (not shown). As shown in FIGS. 1 to 4, the vane pump 1 includes a housing 2, the rotor 3, and the vane 4.

(Housing 2)

The housing 2 is fixed to a side surface of an engine (not shown). The housing 2 includes a housing body 20, a cover 21, and a pump chamber C. The rear surface of the cover 21 is included in the concept of the "inner surface of the housing" of the present invention.

The housing body 20 has the shape of a bottomed elliptic cylinder that is open toward the front. The housing body 20 includes a peripheral wall portion 200 and a bottom wall portion 201. The peripheral wall portion 200 has the shape of an elliptic cylinder. The peripheral wall portion 200 has an inlet port 200*a*. The inlet port 200*a* extends through the peripheral wall portion 200 in the vertical direction. The inlet port 200*a* is coupled to the booster of the brake device through an inlet passage (not shown) having a check valve. The bottom wall portion 201 seals the rear opening of the peripheral wall portion 200. The bottom wall portion 201 has a through hole 201*a*, an outlet port 201*d*, and an oil groove P3. The through hole 201*a* extends through the bottom wall portion 201 in the longitudinal direction (axial direction). The oil groove P3 is formed in the upper end of the inner peripheral surface of the through hole 201*a*. The oil groove P3 extends in the longitudinal direction. The outlet port 201*d* extends through the bottom wall portion 201 in the longitudinal direction. The outlet port 201*d* is located near the front end in the rotational direction of the vane 4 in the pump chamber C. The outlet port 201*d* can be opened and closed by a reed valve (not shown).

The cover 21 seals the front opening of the housing body 20. The cover 21 is fixed to the housing body 20 with a plurality of bolts 90 and a plurality of nuts (not shown). An O-ring 92 is placed between the cover 21 and the housing body 20.

The pump chamber C is defined in the housing 2. The pump chamber C has an elliptical shape as viewed from the front. The pump chamber C communicates with the booster of the brake device through the inlet port 200*a* and the inlet passage. The pump chamber C also communicates with the outside of the vane pump 1 (an engine compartment) through the outlet port 201*d* and the reed valve.

(Rotor 3)

The rotor 3 can rotate with the camshaft. The rotor 3 includes a rotor body 30, a coupling protrusion 31, and an oil chamber A. The rotor body 30 has the shape of a bottomed perfectly circular cylinder that is open toward the front. The rotor body 30 includes a peripheral wall portion 300 and a bottom wall portion 301. The peripheral wall portion 300 has the shape of a perfectly circular cylinder. The peripheral wall portion 300 is accommodated in the pump chamber C. The front end face of the peripheral wall portion 300 is included in the concept of the "end face of the peripheral wall portion" of the present invention. The peripheral wall portion 300 has a pair of vane holding grooves 300*a* and a plurality of oil grooves 300*b*. The pair of vane holding grooves 300*a* extend through the peripheral wall portion 300 in a diameter direction.

Figure 5:
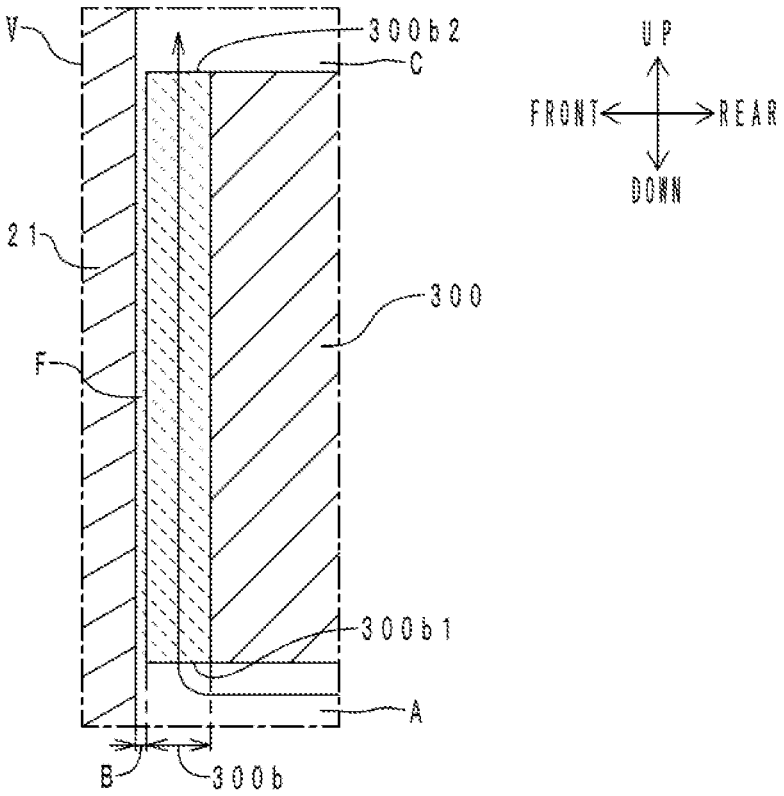
FIG. 5 is an enlarged view of portion V in FIG. 4.

The plurality of oil grooves 300*b* are formed in the front end face of the peripheral wall portion 300. The plurality of oil grooves 300*b* are formed in a radial pattern about the radial center of the rotor 3 so as to be separated from each other by a predetermined angle, as viewed from the front. Each of the plurality of oil grooves 300*b* extends in the radial direction about the radial center of the rotor 3. The oil grooves 300*b* have a C-shaped transverse section (section in the direction perpendicular to the direction in which the oil groove 300*b* extends). The depth of the oil grooves 300*b* is about 100 μm. The width of the oil grooves 300*b* is about 100 μm. FIG. 5 is an enlarged view of portion V in FIG. 4. As shown in FIG. 5, a sliding interface B is defined between the rear surface of the cover 21 and the front end face of the peripheral wall portion 300. The longitudinal clearance width of the sliding interface B is about 50 μm. An oil film F is formed in this clearance.

As shown in FIGS. 2 and 4, the bottom wall portion 301 seals the rear opening of the peripheral wall portion 300. The bottom wall portion 301 is accommodated in the through hole 201*a*. The bottom wall portion 301 has an oil hole P2. The oil hole P2 extends through the bottom wall portion 301 in the diameter direction. As shown in FIG. 2, the oil hole P2 can communicate with the oil groove P3 only at a predetermined rotation angle.

The coupling protrusion 31 is continuous with the rear of the bottom wall portion 301. The coupling protrusion 31 extends in a diameter direction of the bottom wall portion 301. The coupling protrusion 31 has an accommodating recess 310 and an oil hole P1. The accommodating recess 310 is formed in the rear end face of the coupling protrusion 31. The oil hole P1 extends in the longitudinal direction. The oil hole P1 allows the accommodating recess 310 and the oil hole P2 to communicate with each other. The coupling protrusion 31 and the camshaft are coupled by a coupling (not shown) and an oil supply joint (not shown). The coupling transmits a rotational force from the camshaft to the rotor 3. The oil supply joint supplies lubricating oil from the camshaft to the rotor 3 (specifically, the accommodating recess 310).

The oil chamber A is defined in the rotor 3. The oil chamber A has the shape of a perfect circle as viewed from the front. The oil chamber A is divided into a pair of semicircular shapes by the vane 4. The oil chamber A communicates with the pump chamber C through the pair of vane holding grooves 300*a* and the sliding interface B (including the plurality of oil grooves 300*b*).

(Vane 4)

The vane 4 can rotate with the rotor 3 and the camshaft. The vane 4 includes a vane body 40 and a pair of caps 41. The vane body 40 has the shape of a rectangular plate. The vane body 40 is accommodated in the pump chamber C. The vane body 40 can reciprocate in the diameter direction of the rotor 3 along the pair of vane holding grooves 300*a*. The vane body 40 can partition the pump chamber C into a plurality of operation chambers C1 to C3 according to the rotation angle. Clearance P4 is defined between the rear end face of the vane body 40 and the bottom wall portion 301.

The pair of caps 41 are placed at both diametric ends of the vane body 40. The caps 41 can protrude radially outward with respect to the vane body 40. The caps 41 are in sliding contact with the inner peripheral surface of the peripheral wall portion 200.

[Operation of Vane Pump]

Next, operation of the vane pump of the present embodiment will be described. As shown in FIG. 2, when the vane pump 1 is driven (when the rotor 3 and the vane 4 are rotated), the oil hole P2 communicates with the oil groove P3 only at a predetermined rotation angle. At this time, an oil passage P is formed between the camshaft and the oil chamber A. The oil passage P includes the oil holes P1, P2, the oil groove P3, and the clearance P4 from upstream to downstream. Lubricating oil O is introduced from the camshaft into the oil chamber A through the oil passage P. The lubricating oil O is stored in the oil chamber A. The amount of lubricating oil O to be stored in the oil chamber A, the storage state of the lubricating oil O in the oil chamber A, etc. are not particularly limited.

As shown in FIG. 5, each oil groove 300*b* has an upstream end (inner peripheral end) 300*b*1 and a downstream end (outer peripheral end) 300*b*2. The upstream end 300*b*1 of the oil groove 300*b* is included in the concept of "one end of the oil groove" of the present invention. The downstream end 300*b*2 of the oil groove 300*b* is included in the concept of the "other end of the oil groove" of the present invention. The lubricating oil O in the oil chamber A is supplied to the oil grooves 300*b* through the upstream ends 300*b*1. The lubricating oil O in the oil grooves 300*b* is supplied to the sliding interface B. The lubricating oil O thus supplied is spread over the entire sliding interface B with rotation of the rotor 3. The oil film F is thus formed in the sliding interface B. The lubricating oil O having formed the oil film F is discharged into the pump chamber C through the downstream ends 300*b*2. The oil film F is thus continuously and fluidly formed in the sliding interface B by the lubricating oil O in the oil grooves 300*b*.

As shown in FIGS. 1 and 3, the capacities of the plurality of operation chambers C1 to C3 are increased or reduced with rotation of the vane 4. With such a change in capacities, the operation chambers C1 to C3 suck air from the booster through the inlet port 200*a*. The air thus sucked is discharged from the operation chambers C1 to C3 to the outside through the outlet port 201*b*.

[Functions and Effects of Vane Pump]

Functions and effects of the vane pump of the present embodiment will be described. As shown in FIGS. 4 and 5, the front end face of the peripheral wall portion 300 of the rotor 3 has the oil grooves 300*b*. The oil grooves 300*b* directly communicate with the oil chamber A of the rotor 3. The lubricating oil O in the oil chamber A therefore directly flows into the oil grooves 300*b*. According to the vane pump 1 of the present embodiment, the oil film F is thus easily formed in the sliding interface B. Sufficient sealability of the sliding interface B is therefore easily provided, and the sliding interface B is easily protected from thrust load. The front end face of the peripheral wall portion 300 and the rear surface of the cover 21 are therefore less likely to wear. According to the vane pump 1 of the present embodiment, members such as the biasing portions and the sliding member of Patent Document 1 need not be additionally disposed in order to provide sufficient sealability of the sliding interface B. An increase in number of parts is thus restrained.

As shown in FIGS. 4 and 5, each oil groove 300*b* extends in the radial direction (the direction crossing the circumferential direction). This allows the lubricating oil O to flow in the radial direction of the sliding interface B. The lubricating oil O can be spread in the circumferential direction of the sliding interface B with rotation of the rotor 3. The oil film F can thus be formed in the entire sliding interface B.

The oil film F need be formed in the sliding interface B. The longitudinal clearance width (see FIG. 5) of the sliding interface B is therefore very small. This makes it difficult for the lubricating oil O to flow from the oil chamber A into the sliding interface B. However, the lubricating oil O continuously flows into the oil chamber A through the oil passage P shown in FIG. 2. Accordingly, as shown in FIG. 4, the lubricating oil O tends to accumulate in the oil chamber A. Moreover, since the lubricating oil O is incompressible fluid, the pressure in the oil chamber A tends to become high with respect to that in the pump chamber C. When the pressure in the oil chamber A becomes high, a large amount of lubricating oil O in the oil chamber A flows at once into the pump chamber C through the sliding interface B in order to release the pressure. The pressure in the oil chamber A changes significantly with the flow of the lubricating oil O. With such a change in pressure in the oil chamber A, the rotor 3 tends to move in the longitudinal direction by an amount corresponding to the longitudinal clearance width of the sliding interface B.

This problem is caused by the fact that "the lubricating oil O tends to accumulate in the oil chamber A of the rotor 3." Accordingly, this problem cannot occur in the type of vane pump disclosed in Patent Document 1 (a vane pump having a shaft inserted radially inside a rotor so as to extend through the rotor and having no oil chamber in the rotor).

In this respect, according to the vane pump 1 of the present embodiment, the oil grooves 300*b* are formed in the front end face of the peripheral wall portion 300 of the rotor 3. The upstream ends 300*b*1 of the oil grooves 300*b* are open to the oil chamber A. The lubricating oil O therefore easily flows from the oil chamber A into the sliding interface B. The downstream ends 300*b*2 of the oil grooves 300*b* are open to the pump chamber C. The lubricating oil O therefore easily flows from the sliding interface B into the pump chamber C. The pressure in the oil chamber A is therefore less likely to become high with respect to that in the pump chamber C. Moreover, the pressure in the oil chamber A does not significantly change even with the flow of the lubricating oil O. The longitudinal clearance width of the sliding interface B is therefore easily stabilized. That is, the rotor 3 is less likely to move in the longitudinal direction.

The downstream ends 300*b*2 of the oil grooves 300*b* are open to the pump chamber C. Accordingly, even if the lubricating oil O is excessively supplied to the sliding interface B, the excess lubricating oil O can be discharged from the sliding interface B into the pump chamber C.

The oil grooves 300*b* are formed in the front end face of the peripheral wall portion 300 of the rotor 3. The longitudinal thickness of the cover 21 is therefore reduced as compared to the case where the oil grooves 300*b* are formed in the rear surface of the cover 21. Accordingly, the cover 21 and the vane pump 1 are reduced in size.

Second Embodiment

Figure 6:
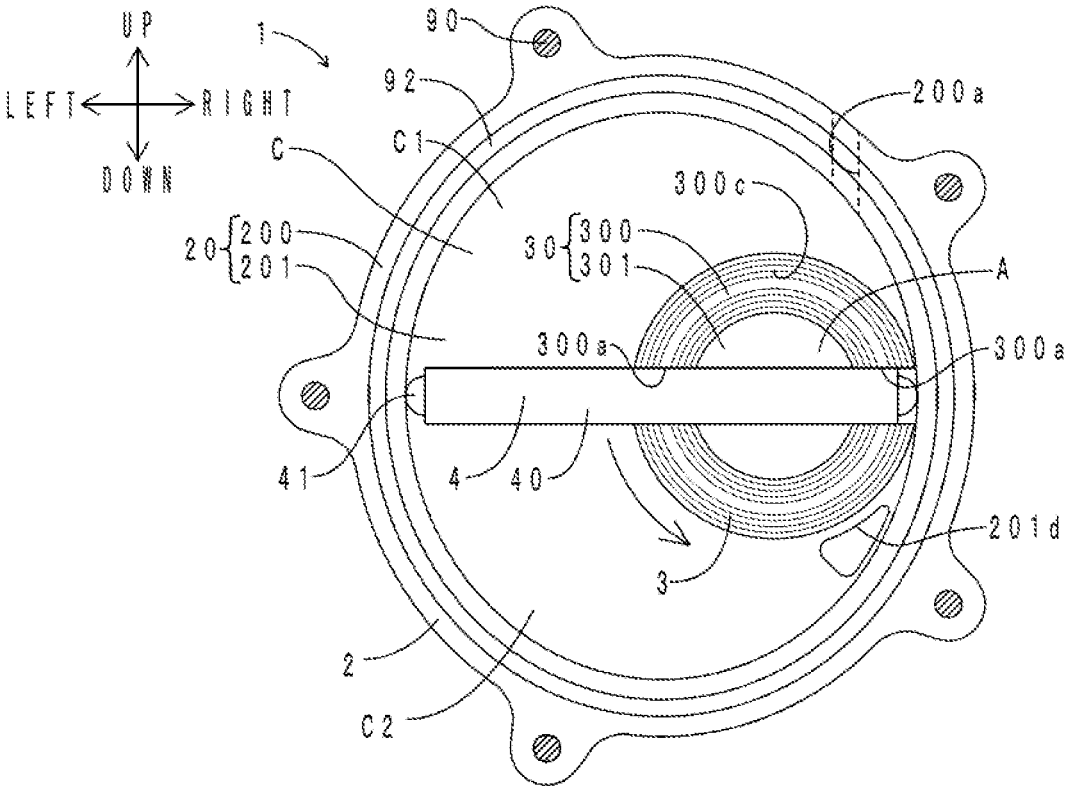
FIG. 6 shows a radial section of a vane pump of a second embodiment.

A vane pump of the present embodiment is different from the vane pump of the first embodiment in that the oil grooves extend in the circumferential direction rather than in the radial direction. Only the difference will be described below. FIG. 6 shows a radial section of the vane pump of the present embodiment. Portions corresponding to those in FIG. 1 are denoted with the same reference characters. As shown in FIG. 6, a plurality of oil grooves 300*c* are formed concentrically about the radial center of the rotor 3, as viewed from the front. Each of the plurality of oil grooves 300*c* extends in the circumferential direction in the shape of an endless ring about the radial center of the rotor 3. The plurality of oil grooves 300*c* indirectly communicate with each other through a sliding interface. The plurality of oil grooves 300*c* indirectly communicate with an oil chamber A and a pump chamber C through the sliding interface.

Regarding the portions having the same configuration as the vane pump of the first embodiment, the vane pump 1 of the present embodiment has functions and effects similar to those of the vane pump of the first embodiment. According to the vane pump 1 of the present embodiment, the rotational direction of the rotor 3 is the same as the direction in which the oil grooves 300*c* extend. An oil film is therefore easily formed in the sliding interface. As in the vane pump 1 of the present embodiment, the oil grooves 300*c* may not directly communicate with the oil chamber A and the pump chamber C.

Other Embodiments

The embodiments of the vane pump of the present invention are described above. However, embodiments are not particularly limited to those described above. The present invention can be carried out in various modified or improved forms that occur to those skilled in the art.

Figure 7A:
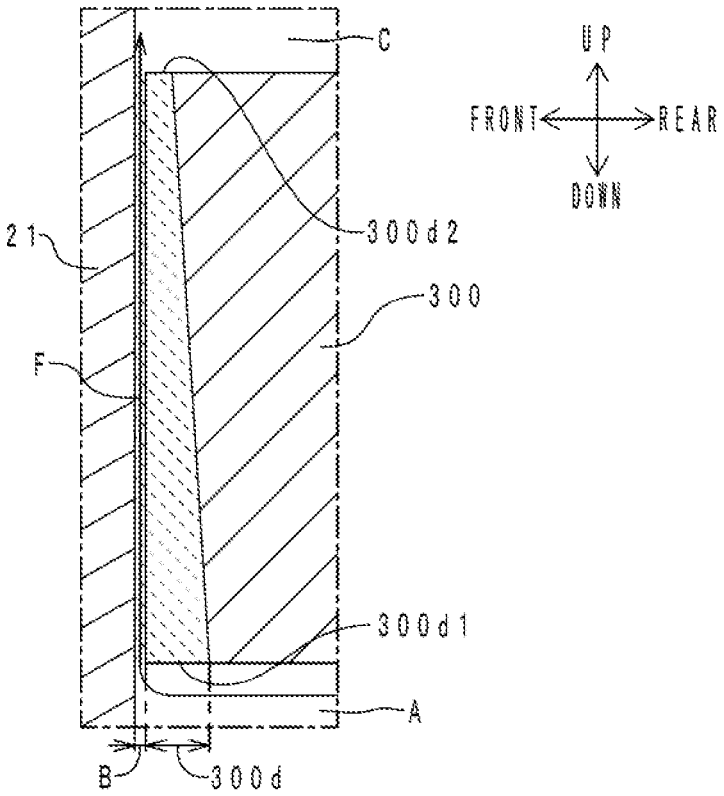
FIG. 7A shows an axial section of a portion near a sliding interface of a vane pump of a further embodiment (third embodiment).
Figure 7B:
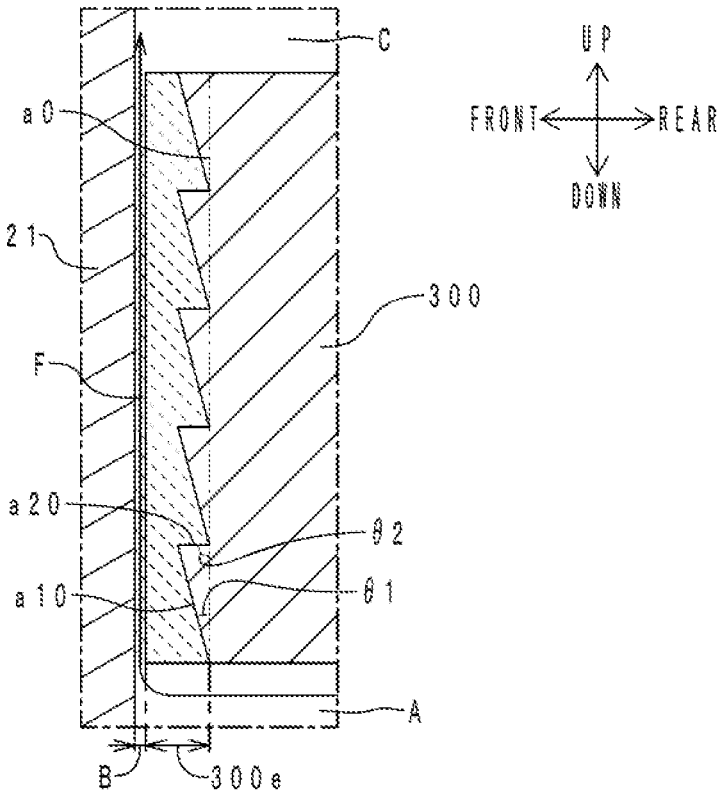
FIG. 7B shows an axial section of a portion near a sliding interface of a vane pump of a still further embodiment (fourth embodiment).
Figure 7C:
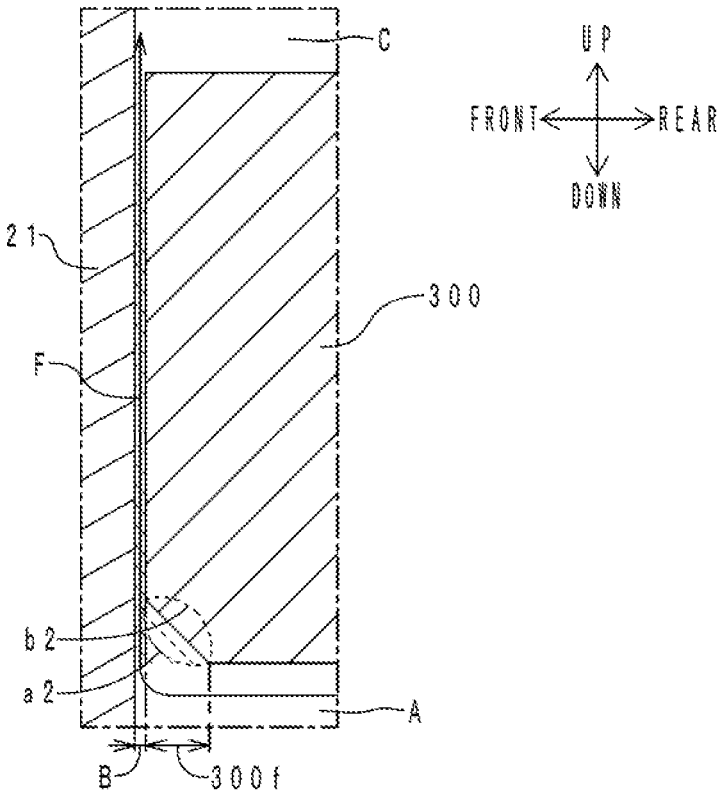
FIG. 7C shows an axial section of a portion near a sliding interface of a vane pump of a yet further embodiment (fifth embodiment).
Figure 7D:
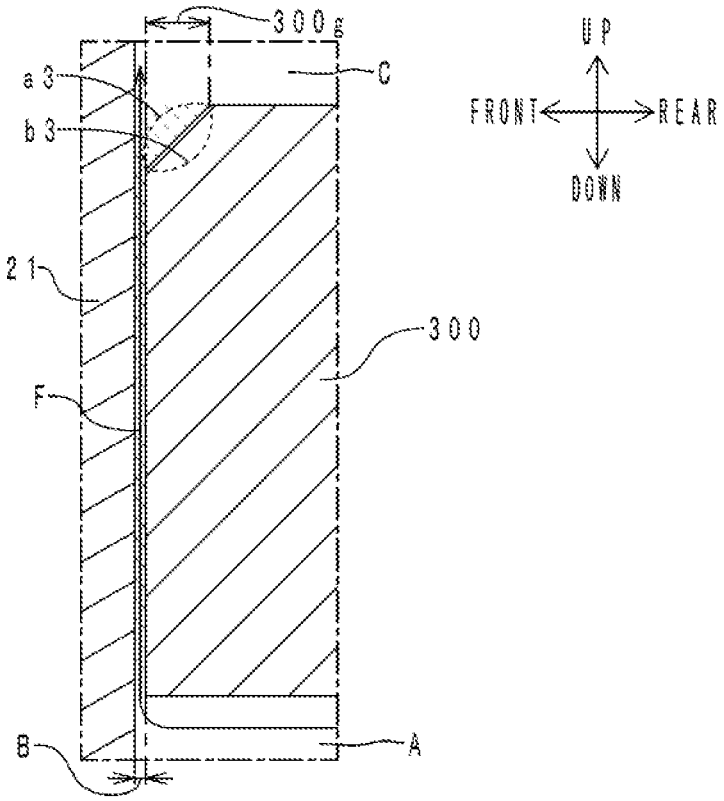
FIG. 7D shows an axial section of a portion near a sliding interface of a vane pump of a yet further embodiment (sixth embodiment).

FIG. 7A shows an axial section of a portion near a sliding interface of a vane pump of a further embodiment (third embodiment). FIG. 7B shows an axial section of a portion near a sliding interface of a vane pump of a still further embodiment (fourth embodiment). FIG. 7C shows an axial section of a portion near a sliding interface of a vane pump of a yet further embodiment (fifth embodiment). FIG. 7D shows an axial section of a portion near a sliding interface of a vane pump of a yet further embodiment (sixth embodiment). Portions corresponding to those in FIG. 5 are denoted with the same reference characters.

As shown in FIG. 7A, an oil groove 300*d* may be formed so that the depth of the oil groove 300*d* decreases as it gets farther away from its upstream end 300*d*1 and closer to its downstream end 300*d*2. In this case, lubricating oil O is less likely to flow from the pump chamber C back into the oil chamber A.

As shown in FIG. 7B, an oil groove 300*e* may be formed so that the depth of the oil groove 300*e* changes in a sawtooth pattern. Tilt angles θ1, θ2 may be θ1<θ2, where θ1 represents the tilt angle, with respect to a radial plane a0, of a slope a10 of any sawtooth portion which faces toward an oil chamber A and θ2 represents the tilt angle, with respect to the radial plane a0, of a slope a20 of any sawtooth portion which faces toward a pump chamber C. In this case, lubricating oil O is less likely to flow from the pump chamber C back into the oil chamber A.

As shown in FIG. 7C, an oil groove 300*f* may be formed by forming a chamfered portion in the inner peripheral edge of the front end face of a peripheral wall portion 300. The oil groove 300*f* extends in the circumferential direction in the shape of an endless ring about the radial center of a rotor 3. Forming the oil groove 300*f* facilitates introduction of lubricating oil O into a sliding interface B. Moreover, the longitudinal clearance width of the sliding interface B is easily stabilized.

As shown in FIG. 7D, an oil groove 300*g* may be formed by forming a chamfered portion in the outer peripheral edge of the front end face of a peripheral wall portion 300. The oil groove 300*g* extends in the circumferential direction in the shape of an endless ring about the radial center of a rotor 3. Forming the oil groove 300*g* facilitates discharge of lubricating oil O from a sliding interface B. Moreover, the longitudinal clearance width of the sliding interface B is easily stabilized.

The oil groove 300*f* and the oil groove 300*g* may be formed in the front end face of a peripheral wall portion 300. In this case, it is more preferable that the oil groove 300*f* be deeper than the oil groove 300*g*. This facilitates introduction of lubricating oil O into a sliding interface B and discharge of the lubricating oil O from the sliding interface B. Moreover, the longitudinal clearance width of the sliding interface B is easily stabilized.

Figure 8:
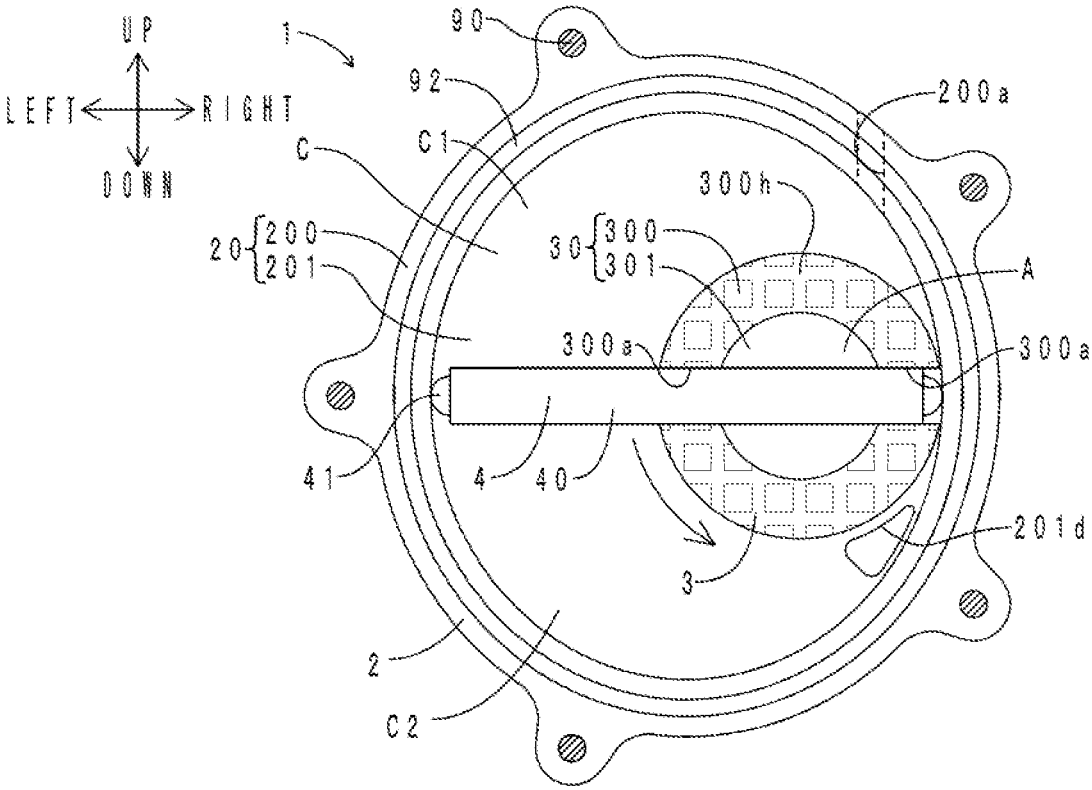
FIG. 8 shows a radial section of a vane pump of a yet further embodiment (seventh embodiment).

FIG. 8 shows a radial section of a vane pump of a yet further embodiment (seventh embodiment). Portions corresponding to those in FIG. 1 are denoted by the same reference characters. As shown in FIG. 8, a grid-like oil groove 300*h* may be formed in the front end face of a peripheral wall portion 300. This facilitates introduction of lubricating oil O into a sliding interface B and discharge of the lubricating oil O from the sliding interface B. Moreover, the longitudinal clearance width of the sliding interface B is easily stabilized.

The number of oil grooves 300*b* to 300*h* and the shape, length, depth, and width of the oil grooves 300*b* to 300*h* are not particularly limited. For example, the upstream end 300*b*1 of the oil groove 300*b* shown in FIG. 5 may not be open to the oil chamber A. Similarly, the downstream end 300*b*2 may not be open to the pump chamber C. The oil grooves 300*c*, 300*f*, 300*g* shown in FIGS. 6, 7C, and 7D may not have the shape of a continuous endless ring as viewed from the front. For example, the oil grooves 300*c*, 300*f*, 300*g* may have the shape of an arc (C-shape). The depth and width of the oil grooves 300*b* to 300*h* may not be constant along their entire length. The shape of the transverse section of the oil grooves 300*b* to 300*h* is not particularly limited. For example, the transverse section of the oil grooves 300*b* to 300*h* may have a C-shape, a U-shape, a V-shape, a W-shape, etc. The shape of the chamfered portions that form the oil grooves 300*f*, 300*g* shown in FIGS. 7C, 7D is not particularly limited. These chamfered portions may be flat chamfered portions or may be round chamfered portions (concave chamfered portions, convex chamfered portions) as shown by dotted lines a2, b2, a3, b3.

The oil grooves 300*b* to 300*h* may be formed in the rear surface (the portion defining the sliding interface B) of the cover 21. In this case as well, the longitudinal clearance width of the sliding interface B is easily stabilized. The oil grooves 300*b* to 300*h* may be formed in both the front end face of the peripheral wall portion 300 and the rear surface of the cover 21. In this case as well, the longitudinal clearance width of the sliding interface B is easily stabilized.

An recessed or protruding shape (e.g., taper lands, dimples, very small protrusions, etc.) may be formed in at least one of the front end face of the peripheral wall portion 300 and the rear surface of the cover 21. In this case as well, the longitudinal clearance width of the sliding interface B is easily stabilized.

DESCRIPTION OF THE REFERENCE NUMERALS

1: Vane Pump, 2: Housing, 20: Housing Body, 200: Peripheral Wall Portion, 200*a*: Inlet Port, 201: Bottom Wall Portion, 201*a*: Through Hole, 201*d*: Outlet Port, 21: Cover, 3: Rotor, 30: Rotor Body, 300: Peripheral Wall Portion, 300*a*: Vane Holding Groove, 300*b* to 300*h*: Oil Groove, 300*b*1: Upstream End, 300*b*2: Downstream End, 300*d*1: Upstream End, 300*d*2: Downstream End, 301: Bottom Wall Portion, 31: Coupling Protrusion, 310: Accommodating Recess, 4: Vane, 40: Vane Body, 41: Cap, 90: Bolt, 92: O-Ring, A: Oil Chamber, B: Sliding Interface, C: Pump Chamber, C1 to C3: Operation Chamber, F: Oil Film, O: Lubricating Oil, P: Oil Passage, P1: Oil Hole, P2: Oil Hole, P3: Oil Groove, P4: Clearance, a0: Radial Plane, a10: Slope, a20: Slope, θ1: Tilt Angle, θ2: Tilt Angle

The invention claimed is:

1. A vane pump comprising:

a housing having a pump chamber;

a rotor having a cylindrical peripheral wall portion accommodated in the pump chamber and having a pair of vane holding grooves facing each other in a diameter direction, and an oil chamber defined inside the peripheral wall portion to store lubricating oil; and a vane that is held in the pair of vane holding grooves and moves across the oil chamber in the diameter direction, wherein at least one of an inner surface of the housing or an end face of the peripheral wall portion, which together with the inner surface of the housing defines a sliding interface, has a plurality of oil grooves for the lubricating oil, and wherein the plurality of oil grooves extends in a circumferential direction, the plurality of oil grooves being formed concentrically about a radial center of the rotor.

2. The vane pump according to claim 1, wherein each oil groove of the plurality of oil grooves is formed in a shape of an endless ring about the radial center of the rotor.

3. The vane pump according to claim 2, wherein the plurality of the oil grooves are formed concentrically on the end face of the peripheral wall portion, and a radially innermost oil groove of the plurality of oil grooves is formed along an inner peripheral edge of the end face of the peripheral wall portion.

4. The vane pump according to claim 2, wherein the oil chamber is divided into a pair of semicircular shapes by the vane as viewed in an axial direction.

5. The vane pump according to claim 1, wherein the plurality of the oil grooves are formed concentrically on the end face of the peripheral wall portion, and a radially innermost oil groove of the plurality of oil grooves is formed along an inner peripheral edge of the end face of the peripheral wall portion.

6. The vane pump according to claim 5, wherein the oil chamber is divided into a pair of semicircular shapes by the vane as viewed in an axial direction.

7. The vane pump according to claim 1, wherein the oil chamber is divided into a pair of semicircular shapes by the vane as viewed in an axial direction.

8. The vane pump according to claim 1, wherein the plurality of oil grooves indirectly communicates with the oil chamber and the pump chamber through the sliding interface.

* * * * *